United States Patent [19]

Fender

[11] Patent Number: 4,463,648

[45] Date of Patent: Aug. 7, 1984

[54] ANGLED HUMBUCKING PICK-UP FOR AN ELECTRICAL MUSICAL INSTRUMENT OF THE STRINGED TYPE

[76] Inventor: C. Leo Fender, 1510 Dana Pl., Fullerton, Calif. 92635

[21] Appl. No.: 490,455

[22] Filed: May 2, 1983

[51] Int. Cl.[3] ..... G10H 3/18

[52] U.S. Cl. ..... 84/1.15; 84/1.16

[58] Field of Search ..... 84/1.15, 1.16

[56] References Cited

U.S. PATENT DOCUMENTS

| | | | |
|---|---|---|---|
| 2,573,254 | 10/1951 | Fender | 84/1.16 |
| 3,962,946 | 6/1976 | Rickard | 84/1.15 |
| 4,026,178 | 5/1977 | Fuller | 84/1.16 |
| 4,096,780 | 6/1978 | Dawson | 84/1.16 |
| 4,171,659 | 10/1979 | Tumminaro | 84/1.16 |
| 4,201,108 | 5/1980 | Bunker | 84/1.16 |
| 4,283,982 | 8/1981 | Armstrong | 84/1.15 |
| 4,379,421 | 4/1983 | Nunan | 84/1.15 |

*Primary Examiner*—Stanley J. Witkowski

*Attorney, Agent, or Firm*—Spensley Horn Jubas & Lubitz

[57] ABSTRACT

A pick-up for an electrical musical instrument of the stringed type which provides better separation between the sound from each string in a humbucking pick-up. This is achieved by longitudinally offsetting from each other a pair of pick-up assemblies mounted in a housing and mounting the pick-up on the body of an electrical musical instrument at an obtuse angle relative to the direction of the strings, the angle of mounting of the housing on the body being a direct function of the longitudinal offset whereby each of the pick-up assemblies is centered under the strings.

2 Claims, 4 Drawing Figures

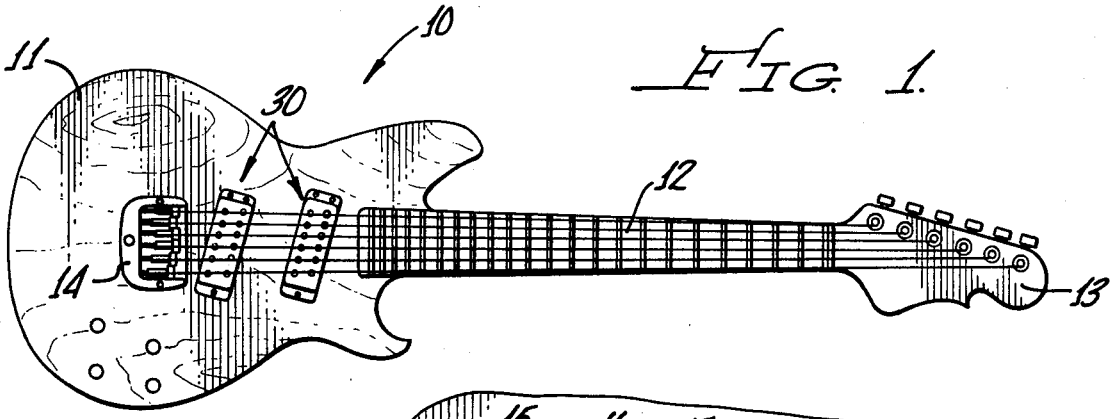
FIG. 1.
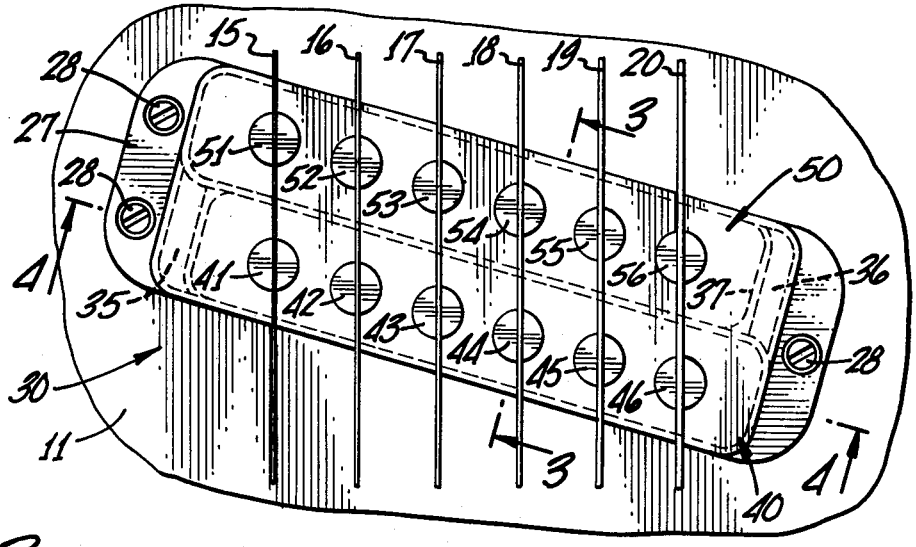
FIG. 2.
FIG. 3.
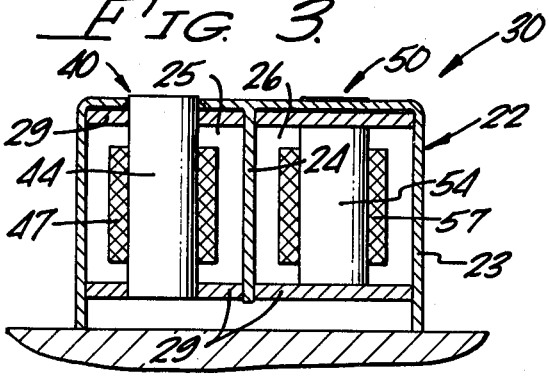
FIG. 4.
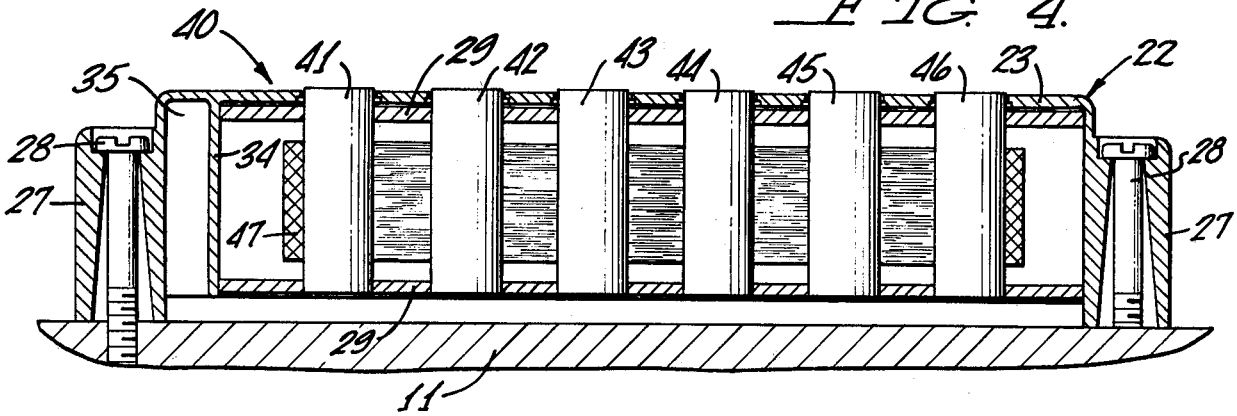

ANGLED HUMBUCKING PICK-UP FOR AN ELECTRICAL MUSICAL INSTRUMENT OF THE STRINGED TYPE

BACKGROUND OF THE INVENTION

1. Field of the Invention

The present invention relates to an angled humbucking pick-up for an electrical musical instrument of the stringed type and, more particularly, to a humbucking pick-up for an electrical musical instrument of the stringed type having enhanced tonal qualities.

2. Description of the Prior Art

The present invention relates broadly to electrical musical instruments of the stringed type. It is typically applicable to an electrical guitar or bass guitar or similar musical instrument having a plurality of stretched strings extending across a body and a neck, between the head of the instrument and a bridge assembly connected to the body, in which the strings are caused to vibrate by plucking or picking same.

In order to derive an output from such an electrical guitar, bass guitar or other similar electrical musical instrument, the instrument is conventionally provided with an electromagnetic pick-up comprising a number of magnetic elements (pole pieces) having wound therearound a conductive coil. Typically, one such magnetic element is disposed directly beneath each string of the instrument. The strings are constructed of a magnetizable substance, such as steel, and, therefore, become part of the conductive path for the magnetic lines of flux of the pole pieces. Accordingly, when any of the strings are caused to vibrate, this causes a disturbance in the magnetic field of the associated pole piece. This has the effect of generating a voltage in the conductive coil, which voltage may be suitably amplified and transmitted to a loudspeaker system.

With such an electromagnetic pick-up construction, a number of problems exist. Electric guitars and other similar electrical musical instruments are used in areas having strong magnetic fields from lighting fixtures, motors, transformers, and the like, and these magnetic fields are sensed by the pick-up as an extraneous noise source. In the United States, such source typically has a frequency of 60 Hz, the usual power line frequency. These magnetic fields induce voltages in the coil which are also amplified and transmitted to the loudspeaker system, manifesting themselves in an objectionable hum.

In order to overcome this problem it is known to provide a pick-up for an electrical musical instrument including a pair of identical pick-up assemblies, each having a plurality of magnetic pole pieces and a coil, the pick-up assemblies being positioned in parallel, spaced, closely adjacent relationship. All of the pole pieces of one of the pick-up assemblies have their north poles adjacent to the strings and their south poles relatively remote from the strings whereas all of the pole pieces of the other pick-up assembly have their south poles adjacent to the strings and their north poles relatively remote from the strings. The coils of the two pick-up assemblies are wound in opposite directions and the two coils are connected either in series or in parallel. Because the direction of current flow in each coil is governed by the magnetic polarity, the direction of current flow in one coil is opposite to that of the other coil for each string. However, since the directions of the windings of the two coils are opposite, the signals induced in the coils as a result of string vibrations are additive and the output signal is the sum of the signals induced in each coil.

On the other hand, signals picked up by the coils from power line sources produce currents in the coils which are independent of the magnetic polarity and, accordingly, such power line sources produce voltages that are in phase. However, since the coils are wound in opposite directions, these in phase signals cancel and the output signal is the difference between the power line signals induced in each coil. This means that any noise from power line sources, which is otherwise manifested as an objectionable hum, is effectively reduced or cancelled. It is for this reason that such an arrangement is typically characterized as a humbucking arrangement.

A typical humbucking pick-up includes a common housing for the first and second pick-up assemblies which are positioned therein in parallel, adjacent, side-by-side relationship. The housing is mounted perpendicular to the direction of the strings so that each pick-up assembly is centered under the strings.

Whether a humbucking pick-up or a single pick-up is used, there are disadvantages to mounting the pick-up assembly perpendicular to the direction of the strings. The reason for this is that in such case, the portion of the pick-up which senses the vibrations of each string has the same position along the string as all other portions of the pick-up so that the harmonic content from each string is essentially identical. Since the harmonic content picked up for each string is essentially the same, the sounds from the individual strings tend to blend together and many find this to be an undesirable quality of pick-ups.

To solve this problem, it has been known, in instruments having single pick-ups, to position the pick-up at an obtuse angle relative to the direction of the strings. With such an arrangement, the pick-up senses different harmonics on each string with the result that there is better separation in the sound from each string and many find this to be highly desirable. However, while it has been known to do this with a single pick-up, it has been unknown heretofore to provide an angled pick-up in a humbucker.

SUMMARY OF THE INVENTION

According to the present invention, there is provided a pick-up for an electrical musical instrument of the stringed type which provides better separation between the sound from each string in a humbucking pick-up. This is achieved by longitudinally offsetting from each other a pair of pick-up assemblies mounted in a housing and mounting the pick-up on the body of an electrical musical instrument at an obtuse angle relative to the direction of the strings, the angle of mounting of the housing on the body being a direct function of the longitudinal offset whereby each of the pick-up assemblies is centered under the strings. The result is a pick-up assembly having the noise reduction capabilities of a humbucking pick-up and the tonal qualities of an angled pick-up.

Briefly, the present invention relates to an electrical musical instrument of the type including a body, a neck having a head, a bridge assembly connected to the body, a plurality of strings positioned between the head and the bridge assembly, and a pick-up mounted on the body and positioned between the neck and the bridge assembly, the pick-up including first and second pick-up assemblies positioned in parallel, adjacent, side-by-side relationship within a common housing, each pick-up assembly including at least one pole piece and a coil wound around the pole piece, the first and second pick-up assemblies being longitudinally offset from each other within the housing and the pick-up being mounted on the body at an obtuse angle relative to the direction of the strings so that the pick-up assemblies are centered under the strings.

OBJECTS, FEATURES AND ADVANTAGES

It is therefore the object of the present invention to solve the problems associated with providing separation between the sounds emanating from the individual strings in an electrical musical instrument when using a humbucking pick-up. It is a feature of the present invention to solve these problems by providing an angled humbucking pick-up. An advantage to be derived is a humbucking pick-up having improved tonal qualities. Another advantage is a humbucking pick-up wherein the harmonics are different for each string. Still another advantage is a pick-up having better separation between the sounds from the individual strings.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like or corresponding parts in the several figures and wherein:

BRIEF DESCRIPTION OF THE DRAWINGS

FIG. 1 is a top plan view of an electrical guitar incorporating the present invention;

FIG. 2 is an enlarged top plan view of a portion of the guitar of FIG. 1 showing just one of the pick-ups; and FIGS. 3 and 4 are enlarged sectional views taken along the lines 3—3 and 4—4, respectively, in FIG. 2.

DESCRIPTION OF THE PREFERRED EMBODIMENT

Referring now to the drawings and, more particularly, to FIG. 1 thereof, the present invention is illustrated as being incorporated in an electrical guitar, generally designated 10, including a body 11, a fretted neck 12 and a head 13 being connected to one end of neck 12, the other end of neck 12 being connected to body 11. Tensioned between head 13 of guitar 10 and a bridge assembly 14 connected to body 11 are a plurality of strings 15–20 which lie approximately in a single plane parallel to the face of body 11.

Strings 15–20 are constructed of a magnetizable substance, such as steel, and are graduated in diameter in a conventional manner. In order to derive an output from guitar 10, it is provided with one or more electromagnetic pick-ups, generally designated 30, which form the subject matter of the present invention. FIG. 1 shows two pick-ups 30, which is one possible embodiment of the present invention. Since both pick-ups 30 are identical, a description of one will suffice to describe both. Vibrations of strings 15–20, as a result of plucking or picking the same, produce an electrical signal in pick-ups 30, which signals may be suitably amplified and transmitted to a loudspeaker system.

Pick-up 30 has a configuration which, generally speaking, is known in the prior art. Specifically, in order to provide humbucking, pick-up 30 includes first and second pick-up assemblies 40 and 50, pick-up assembly 40 preferably comprising a plurality of identical magnetic elements (pole pieces) 41–46, which may be magnetized in any one of several ways known to those skilled in the art, and pick-up assembly 50 preferably comprising a similar plurality of identical magnetic elements (pole pieces) 51–56. The number of pole pieces 41–46 and the number of pole pieces 51–56 are preferably identical and preferably the same as the number of strings 15–20. However, this is not required. Each pick-up assembly could consist of a single bar or blade, there could be fewer pole pieces than the number of strings, or there could be more pole pieces than the number of strings.

In any event, pick-up assemblies 40 and 50 are mounted within a common housing, generally designated 22. Housing 22 is a generally elongate, cup-shaped member having an outer wall 23 and an elongate central partition 24 so as to define compartments 25 and 26 for pick-up assemblies 40 and 50, respectively. Housing 22 may be provided with end flanges 27 through which a plurality of screws 28 may extend for securing housing 22 to body 11.

As shown in FIGS. 3 and 4, each pick-up assembly 40 and 50 is formed by positioning its associated pole pieces between a pair of spacers 29. Pick-up assemblies 40 and 50 include coils 47 and 57, respectively, which are wound around pole pieces 41–46 and 51–56, respectively, between spacers 29. Coils 47 and 57 are formed from a large number of turns of fine conductive wire. The wire in coils 47 and 57 are insulated, such as with varnish or lacquer, and the entire assembly comprising the pole pieces, the spacers and the coils are preferably dipped in a suitable varnish or lacquer. As is known in the art, movement of strings 15–20, as in the strumming or playing of guitar 10, results in voltages being induced in the coils. These voltages are transferred to the input circuit of an amplifier and a loudspeaker system.

In order to provide a humbucking arrangement, pole pieces 41–46 of pick-up assembly 40 have their north poles adjacent to strings 15–20 and their south poles relatively remote from strings 15–20 whereas pole pieces 51–56 of pick-up assembly 50 have their south poles adjacent to strings 15–20 and their north poles relatively remote from strings 15–20. This arrangement may be reversed. Furthermore, coils 47 and 57 are wound in opposite directions and typically connected in series between an output lead and ground.

Because the direction of current flow in each coil is governed by the magnetic polarity, the direction of current flow in each coil is opposite to that of the other coil for each string. However, since the direction of winding of the two coils is opposite, the voltages induced in the coils as a result of string vibrations are additive, and the signal output on the output lead is the sum of the voltages induced in each coil.

On the other hand, signals picked up by coils 47 and 57 from the power line service produce currents therein which are independent of the magnetic polarity and, accordingly, such extraneous signals produce voltages that are in phase. However, since coils 47 and 57 are wound in opposite directions, these in phase signals cancel and the signal output on the output lead is the difference between the extraneous signal voltages induced in each of coils 47 and 57. This means that any noise from power line sources, typically in the range of 0–150 Hz, which is otherwise manifested as an objectionable hum, is effectively reduced or canceled. It is for this reason that the arrangement is characterized as a humbucking arrangement.

According to the present invention, pick-up assemblies 40 and 50 are longitudinally offset from each other within housing 22. That is, compartments 25 and 26 are offset from each other with compartment 25 being spaced by a wall 34 at one end thereof from another compartment 35 and compartment 26 being spaced by a wall 37 from another compartment 36 at the opposite end thereof. This may be clearly seen in FIGS. 2 and 4. Furthermore, pick-up 30 is mounted on body 11 at an obtuse angle relative to the direction of strings 15–20, the angle of mounting of housing 22 on body 11 being a direct function of the longitudinal offset between pick-up assemblies 40 and 50. That is, and as shown in FIG. 2, the angle of mounting of housing 22 on body 11 is selected so that each of pick-up assemblies 40 and 50 is centered under strings 15–20. Thus, it is seen that in spite of the angle of housing 22, pole pieces 41 and 51 are aligned with string 15, pole pieces 42 and 52 are aligned with string 16, and pole pieces 43–56 and 53–56 are aligned with strings 17–20, respectively. The result is a pick-up assembly 30 having the noise reduction capabilities of a humbucking pick-up and the enhanced tonal qualities previously encountered with single angled pick-ups.

While the invention has been described with respect to the preferred physical embodiment constructed in accordance therewith, it will be apparent to those skilled in the art that various modifications and improvements may be made without departing from the scope and spirit of the invention. For example, in another embodiment of the present invention, central partition 24 and walls 34 and 37 are omitted, pick-up assemblies 30 and 40 being located within housing 22 by virtue of pole pieces 41–46 and 51–56 extending through mating holes in the top surface of outer wall 23 of housing 22. Accordingly, it is to be understood that the invention is not to be limited by the specific illustrative embodiment, but only by the scope of the appended claims.

I claim:

1. In an electrical musical instrument of the type including a body, a neck having a head, a bridge assembly connected to said body, a plurality of strings positioned between said head and said bridge assembly, and a pick-up mounted on said body and positioned between said neck and said bridge assembly, said pick-up including first and second pick-up assemblies positioned in parallel, adjacent, side-by-side relationship, each pick-up assembly including at least one pole piece and a coil wound around said pole piece, and a common housing for said first and second pick-up assemblies, the improvement wherein said first and second pick-up assemblies are longitudinally offset from each other within said housing and wherein said pick-up is mounted on said body at an obtuse angle relative to the direction of said strings, the angle of mounting of said housing on said body being a function of said longitudinal offset whereby each of said pick-up assemblies is centered under said strings.

2. In an electrical musical instrument according to claim 1, the improvement wherein each pick-up assembly includes a plurality of pole pieces, one for each of said strings, and wherein said pick-up is mounted on said body so that said pole pieces are aligned with said strings of said instrument.

* * * * *